US009889696B2

(12) United States Patent
Takada et al.

(10) Patent No.: US 9,889,696 B2
(45) Date of Patent: Feb. 13, 2018

(54) COATED PAPER FOR INDUSTRIAL INKJET PRINTING PRESSES AND METHOD OF PRODUCING THE SAME

(71) Applicant: MITSUBISHI PAPER MILLS LIMITED, Tokyo (JP)

(72) Inventors: Hideki Takada, Tokyo (JP); Tetsuya Nishi, Tokyo (JP); Masanori Nagoshi, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 15/456,951

(22) Filed: Mar. 13, 2017

(65) Prior Publication Data

US 2017/0267010 A1 Sep. 21, 2017

(30) Foreign Application Priority Data

Mar. 15, 2016 (JP) ..... 2016-051122

(51) Int. Cl.
*B41M 5/50* (2006.01)
*B41M 5/52* (2006.01)
(Continued)

(52) U.S. Cl.
CPC ..... *B41M 5/5245* (2013.01); *B41M 5/5218* (2013.01); *D21H 19/385* (2013.01); *D21H 19/40* (2013.01); *D21H 19/56* (2013.01)

(58) Field of Classification Search
CPC ..... B41M 5/5218; B41M 5/5245
See application file for complete search history.

(56) References Cited

U.S. PATENT DOCUMENTS

2011/0298879 A1* 12/2011 Asao ..... B41M 5/00 347/105
2011/0300315 A1* 12/2011 Asakawa ..... B41M 5/00 428/32.2

(Continued)

FOREIGN PATENT DOCUMENTS

JP 8-2091 A 1/1996
JP 2000-190631 A 7/2000

(Continued)

OTHER PUBLICATIONS

Tokumasu, "Inkjet Printer Compatible with B2 Wide Format Printing Paper" (Japan Printer, Insatsu Gakkai Shuppanbu Ltd., Aug. 2010 (vol. 93), pp. 21-24).

(Continued)

*Primary Examiner* — Betelhem Shewareged
(74) *Attorney, Agent, or Firm* — Birch, Stewart, Kolasch & Birch, LLP

(57) ABSTRACT

A coated paper for industrial inkjet printing presses that achieves excellent uniformity in color densities and ink absorbability, has the capability of suppressing strike-through of inks, and achieves excellent paper feeding characteristics is provided. The paper comprises: a base paper, and a coating layer containing at least one selected from the group consisting of a cationic resin and a water-soluble polyvalent cationic salt, and a pigment containing kaolin, on the base paper. The coated paper surface on the side where the coating layer is located has an arithmetic mean roughness (Ra) of is 4.5 μm to 7.5 μm, and has 1 to 350 protruding parts per 1.0 square centimeter, wherein a protruding part has a maximum width of 10 μm to 100 μm measured using a photographed image of the coated paper surface taken by magnifying 50 times using an electron microscope.

1 Claim, 1 Drawing Sheet

(51) Int. Cl.

| | |
|---|---|
| ***D21H 19/38*** | (2006.01) |
| ***D21H 19/40*** | (2006.01) |
| ***D21H 19/56*** | (2006.01) |

(56) References Cited

U.S. PATENT DOCUMENTS

| | | | | |
|---|---|---|---|---|
| 2011/0300316 | A1* | 12/2011 | Tanaka | B41M 5/00 428/32.31 |
| 2012/0040147 | A1* | 2/2012 | Komatsu | B41M 5/0011 428/195.1 |
| 2014/0004263 | A1* | 1/2014 | Noguchi | B41M 5/502 427/256 |

FOREIGN PATENT DOCUMENTS

| | | | |
|---|---|---|---|
| JP | 2005-88525 | A | 4/2005 |
| JP | 2010-83034 | A | 4/2010 |
| JP | 2010-89345 | A | 4/2010 |
| JP | 2011-251231 | A | 12/2011 |

OTHER PUBLICATIONS

Miyagi, "Offset Quality Inkjet Printer" (Japan Printer, Insatsu Gakkai Shuppanbu Ltd., Aug. 2010 (vol. 93), pp. 25-29).

* cited by examiner

COATED PAPER FOR INDUSTRIAL INKJET PRINTING PRESSES AND METHOD OF PRODUCING THE SAME

CROSS-REFERENCE TO RELATED APPLICATIONS

The present application claims priorities to Japanese Patent Application No. 2016-051122, filed Mar. 15, 2016. The contents of this application are incorporated herein by reference in their entirety.

BACKGROUND OF THE INVENTION

Field of the Invention

The present invention relates to coated paper for industrial inkjet printing presses that is used for industrial inkjet printing presses for commercial printing.

Description of Related Art

Technologies for inkjet recording method have rapidly progressed, and industrial inkjet printing presses in which an inkjet recording method is employed for an industrial or commercial digital printing press to produce a multiple sheets of commercial printed materials have been known (e.g. see Patent Documents 1 and 2 and Non-Patent Documents 1 and 2). Industrial inkjet printing presses are marketed under trade names such as Truepress Jet manufactured by SCREEN Graphic and Precision Solutions Co. Ltd., the MJP Series manufactured by Miyakoshi Printing Machinery Co., Ltd., Prosper and Versamark manufactured by Eastman Kodak Co., JetPress manufactured by Fujifilm Corp., and Web Press manufactured by Hewlett-Packard Development Company, L.P.

These industrial inkjet printing presses feature color printing speeds that are ten to several tens of times faster than inkjet printers for home and small office/home office (SOHO) use as well as wide format inkjet printers, demonstrating printing speeds of 15 m/min or higher and exceeding 60 m/min in the case of high-speed printing, depending on various printing conditions. Because of this, industrial inkjet printing presses are distinguished from inkjet printers for home and SOHO use and wide format inkjet printers.

Since industrial inkjet printing presses are capable of handling variable information, they can be adapted to on-demand printing. Printing firms usually employ a system by which fixed information is printed with conventional printing presses such as gravure printing presses, offset printing presses, letterpress printing presses, flexographic printing presses, thermal transfer printing presses, or toner printing presses, and variable information is printed with industrial inkjet printing presses. As conventionally used printing presses, in particular, offset printing presses are used from the perspectives of quality of printed images and production cost.

A recording medium which has reduced excessive surface reflection and which is recorded by an inkjet recording method, and in which, on a substrate having a center line average roughness of 0.20 μm or less, at least one ink receiving layer containing an inorganic pigment and a polymer binder, and a surface reflection reducing layer containing an inorganic pigment and a polymer binder are laminated sequentially; the surface reflection reducing layer having gel-like protrusions scattered on its surface has been publicly known (e.g. see Patent Document 3).

Patent Documents

Patent Document 1: Japanese Patent Application Kokai Publication No. 2011-251231 (unexamined, published Japanese patent application)

Patent Document 2: Japanese Patent Application Kokai Publication No. 2005-088525 (unexamined, published Japanese patent application)

Patent Document 3: Japanese Patent Application Kokai Publication No. 2000-190631 (unexamined, published Japanese patent application)

Non-Patent Documents

Non-patent document 1: "Ink-jet printer applicable to B2-size printing paper", written by Michiko Tokumasu ("Japan Printer", published by Insatsu Gakkai Shuppanbu Ltd., August 2010 (Vol. 93), pages 21 to 24)

Non-patent document 2: "Offset-quality ink-jet printer", written by Yasutoshi Miyagi ("Japan Printer", published by Insatsu Gakkai Shuppanbu Ltd., August 2010 (Vol. 93), pages 25 to 29)

BRIEF SUMMARY OF THE INVENTION

Inks used in industrial inkjet printing presses are roughly classified into aqueous pigment inks, in which the coloring material is a pigment, and aqueous dye inks, in which the coloring material is a dye, and aqueous pigment inks and aqueous dye inks have different drawbacks. With aqueous pigment inks, color densities of a printed part becomes uneven occasionally when partial unevenness in ink absorbability on the printing paper occurs as the printing speed is increased. This is because, based on the principle of inkjet, i.e., an ink droplet is ejected from a fine nozzle, inks used in industrial inkjet printing presses have lower coloring material concentrations compared to the coloring material concentrations of inks for conventional printing presses, such as offset printing presses. Therefore, coated paper for industrial inkjet printing presses exhibiting excellent uniformity in color densities has been desired. With aqueous dye inks, color boundary occasionally blurs in a printed part when ink absorbability of the printing paper is insufficient as the printing speed is increased. Therefore, coated paper for industrial inkjet printing presses exhibiting excellent ink absorbability has been desired.

Furthermore, recently, coated paper for industrial inkjet printing presses is required to suppress occurrence of strike-through of ink. Since inks for industrial inkjet printing presses have lower coloring material concentrations of the inks and contain greater amounts of ink solvents compared to those of inks for conventional printing presses, such as offset printing presses, strike-through of ink readily occurs. "Strike-through of ink" is a phenomenon in which the ink does not stop on the surface of the printed side of coated paper but reaches the deep portion of the base paper, and thus the printed image can be visually recognized from the back surface on the printed face. In commercial printing, printing is often performed on the both surfaces, and the strike-through of ink impairs sufficient image quality as a product. Therefore, coated paper for industrial inkjet printing presses with capability of suppressing strike-through of inks has been desired.

Furthermore, in recent years, coated paper for industrial inkjet printing presses is required to have high post-processing suitability. The post-processing of the coated paper for industrial inkjet printing presses includes paper-folding treatment, enclosing/sealing treatment, and the like. For example, paper-folding machines that are used to fold advertisement for direct mails or the like into a size that can be enclosed in an envelope are known. When paper is supplied to a paper-folding machine to be folded, the paper needs to be supplied to the paper-folding machine one by one, and typically, a paper-feeding device that separates one sheet of paper from a bundle of sheet-like paper to transport the one sheet of paper is provided.

Typical paper-feeding devices include an air suction type which separates paper one by one by air suction and transports the paper, and a friction type which separates paper one by one by utilizing friction force of a material with high coefficient of friction, such as rubber, and the paper and transports the paper. The air suction type tends to have poor capability of separating the paper one by one from a paper bundle compared to the case of the friction type. In the air suction type, when air suction of the surface of the coated paper fails, transport troubles including failure of separating one sheet of paper from a paper bundle (feeding failure), transporting a plurality of sheets at the same time (multi feed), feeding paper in an oblique direction (skew), and the like, occur. In the friction type, if sufficient friction force is not caused in between the paper and the belt or roller for feeding paper, transport troubles occur. The materials, such as rubber, used typically in rollers or belts deteriorate as they are used, and the friction force is reduced as time passes. In such a case, transport troubles often occur due to sliding caused in between the paper and the roller or belt. From the perspective of productivity of commercial printed materials, the coated paper for industrial inkjet printing presses is required to exhibit excellent paper feeding characteristics that hardly cause transport troubles using a paper-feeding machine with any one of these types.

The recording medium described in Patent Document 3 aims at changing the surface quality to reduce surface reflection and is provided with a large number of gel-like protrusions that are arranged uniformly. Therefore, the recording medium described in Patent Document 3 cannot solve the transport troubles without affecting the change in surface quality achieved by presence or absence of the gel-like protrusions.

An object of the present invention is to provide a coated paper for industrial inkjet printing presses that achieves excellent uniformity in color densities and ink absorbability, that has capability of suppressing strike-through of inks, and that achieves excellent paper feeding characteristics.

The object of the present invention described above can be solved by a coated paper for industrial inkjet printing presses, the coated paper comprising:

a base paper, and a coating layer containing: at least one selected from the group consisting of a cationic resin and a water-soluble polyvalent cationic salt, and a pigment containing kaolin, on the base paper;

wherein the content of the kaolin is 30 parts by mass to 80 parts by mass based on 100 parts by mass of the pigment in the coating layer, an arithmetic mean roughness (Ra) stipulated in JIS B 0601:2001 (ISO 4287:1997) of a coated paper surface on the side where the coating layer is located is 4.5 μm to 7.5 μm, the coated paper surface on the side where the coating layer is located has 1 to 350 protruding parts per 1.0 square centimeter, and the protruding part is a protruding part having the maximum width of 10 μm to 100 μm measured using a photographed image of the coated paper surface taken by magnifying 50 times using an electron microscope.

Normally, protruding parts are not preferable for the surface quality of coated paper; however, the inventors of the present invention have found that the size and the number of protruding parts of the present invention act favorably regarding paper feeding characteristics of the air suction type and/or friction type without affecting the surface quality.

According to the present invention, a coated paper for industrial inkjet printing presses that achieves excellent uniformity in color densities and ink absorbability, that has capability of suppressing strike-through of inks, and that achieves excellent paper feeding characteristics can be provided.

DETAILED DESCRIPTION OF THE INVENTION

Figure 1:
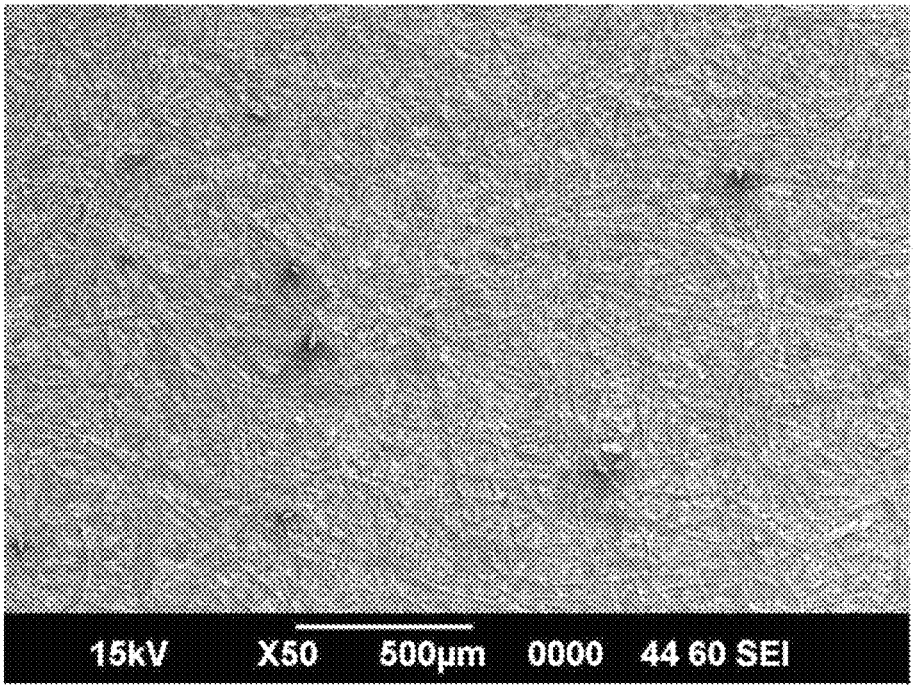
FIG. 1 is an electron micrograph observing a coated paper surface on the side where the coating layer is located of the coated paper for industrial inkjet printing presses of the present invention.

The present invention will be described below in detail.

The coated paper of the present invention can be used in printing using an industrial inkjet printing press. When used in the present description, an "industrial inkjet printing press" refers to a printing machine using an inkjet recording method and demonstrating printing speeds of 15 m/min or higher and exceeding 60 m/min in the case of high-speed printing. Industrial inkjet printing presses are described in, for example, Patent Documents 1 and 2 and Non-Patent Documents 1 and 2, and marketed under trade names such as Truepress Jet manufactured by SCREEN Graphic and Precision Solutions Co. Ltd., the MJP Series manufactured by Miyakoshi Printing Machinery Co., Ltd., Prosper and Versamark manufactured by Eastman Kodak Co., JetPress manufactured by Fujifilm Corp., and Web Press manufactured by Hewlett-Packard Development Company, L.P. Types of ink equipped in the industrial inkjet printing press include aqueous dye inks and aqueous pigment inks; however, in the present invention, any of the ink types of the industrial inkjet printing press can be used.

The coated paper of the present invention can be printed using conventional printing presses. When the image to be printed has both variable information and fixed information, all or a part of the fixed information is preferably printed by using a conventional printing press, such as a gravure printing press, offset printing press, letterpress printing press, flexo printing press, thermal transfer printing press, or toner printing press. From the perspectives of production cost and image quality, an offset printing press is particularly preferable. A conventional printing press may be used before or after the printing using an industrial inkjet printing press.

Gravure printing presses are printing presses using a method that transfers ink to a material to be printed via a roll-like plate cylinder on which an image has been carved into. Offset printing presses are printing presses using an indirect printing method that transfers ink once to a blanket and then transfers the ink again to a material to be printed. Letterpress printing presses are printing presses using a letterpress method that prints by applying pressure to press an ink provided on relief printing plate to a material to be printed. Flexo printing presses are printing presses using a letterpress method using a resin plate having flexibility and elasticity. Thermal transfer printing presses are printing presses using an ink ribbon of each color and using a method that transfers a coloring material from the ink ribbon to a material to be printed by heat. Toner printing presses are printing presses using an electrophotography method that transfers toner, which is adhered to a charged drum, to a material to be printed utilizing static electricity.

The coated paper of the present invention contains a base paper. The base paper is a paper formed by using paper stock obtained by adding, into chemical pulp such as leaf bleached kraft pulp (LBKP) and needle bleached kraft pulp (NBKP), mechanical pulp such as groundwood pulp (GP), pressure groundwood pulp (PGW), refiner mechanical pulp (RMP), thereto mechanical pulp (TMP), chemi-thermo mechanical pulp (CTMP), chemi mechanical pulp (CMP), and chemi groundwood pulp (CGP), or recycled pulp such as deinked pulp (DIP), a filler such as calcium carbonate, and, as necessary, blending various additives such as sizing agents, retention aids, cationic compounds, pigment dispersants, thickeners, fluidity improving agents, defoamers, antifoamers, releasing agents, foaming agents, penetrating agents, coloring dyes, coloring pigments, optical brighteners, ultraviolet absorbing agents, antioxidants, preservatives, fungicides, insolubilizers, wet paper strength enhancing agents, and dry paper strength enhancing agents, under an acidic, neutral, or alkaline condition.

The base paper can be subjected to size press treatment using a size press composition. The surface sizing agent used in the size press composition is a surface sizing agent that is conventionally known in the field of papermaking, and examples thereof include a styrene-acrylic sizing agent, olefin-based sizing agent, styrene-maleic acid-based sizing agent, and the like. Furthermore, the size press composition may further contain various additives besides the surface sizing agent.

The coated paper of the present invention contains a coating layer on the base paper. The coating layer of the present invention contains at least one selected from the group consisting of a cationic resin and a water-soluble polyvalent cationic salt, and a pigment containing kaolin. The coating layer contains the kaolin as the pigment in an amount of 30 parts by mass to 80 parts by mass based on 100 parts by mass of the total solid content of the pigment in the coating layer. When the kaolin content of the coating layer is less than 30 parts by mass based on 100 parts by mass of the total solid content of the pigment in the coating layer, paper feeding characteristics are particularly deteriorated. When the kaolin content of the coating layer is more than 80 parts by mass based on 100 parts by mass of the total solid content of the pigment in the coating layer, uniformity of color densities and ink absorbability are deteriorated.

The coating layer contains a conventionally known pigment besides kaolin. Examples of the conventionally known pigment include inorganic pigments, such as ground calcium carbonate, precipitated calcium carbonate, talc, titanium oxide, zinc oxide, synthetic silica, satin white, alumina, and aluminum hydroxide, varieties of organic pigments, and the like.

The coating layer contains at least one selected from the group consisting of a cationic resin and a water-soluble polyvalent cationic salt.

The cationic resin is a cationic polymer or a cationic oligomer, and conventionally known cationic resins can be used. Preferable cationic resins are polymers or oligomers containing quaternary ammonium salts or primary to tertiary amines to which a proton is easily coordinated and which dissociate to exhibit cationic characteristics when dissolved in water. Examples of the cationic resin include compounds such as polyethyleneimine, polyvinylpyridine, polyaminesulfone, polydialkylaminoethyl methacrylate, polydialkylaminoethyl acrylate, polydialkylaminoethyl methacrylamide, polydialkylaminoethyl acrylamide, polyepoxyamine, polyamidoamine, dicyandiamide-formalin condensates, polyvinylamine, and polyallylamine, and hydrochlorides of these, as well as polydiallyldimethylammonium chloride, and copolymers of diallyldimethylammonium chloride and acrylamide or the like, polydiallylmethylamine hydrochloride, polycondensates of aliphatic monoamine or aliphatic polyamine with an epihalohydrin compound, such as dimethylamine-epichlorohydrin polycondensates and diethylenetriamine-epichlorohydrin polycondensates; however, the cationic resin is not limited to these. From the perspectives of commercial availability and formation of protruding part described below, dimethylamine-epichlorohydrin polycondensates are preferable. In the present invention, the average molecular weight of the cationic resin is not particularly limited; and the average molecular weight is preferably in the range of 500 to 20,000.

The water-soluble polyvalent cationic salt is a water-soluble salt containing a polyvalent metal cation. Preferable salt of polyvalent cation is a salt such that 1% by mass or more of the salt can be dissolved in water at 20° C., the salt containing a polyvalent metal cation. Examples of the polyvalent metal cation include divalent cations, such as magnesium, calcium, strontium, barium, nickel, zinc, copper, iron, cobalt, tin, and manganese; trivalent cations, such as aluminum, iron, and chromium; tetravalent cations, such as titanium and zirconium; and complex ions of these. An anion that forms a salt with the polyvalent metal cation may be any inorganic acid or organic acid, and is not particularly limited. Examples of the inorganic acid include hydrochloric acid, nitric acid, phosphoric acid, sulfuric acid, boric acid, hydrofluoric acid, and the like. Examples of the organic acid include formic acid, acetic acid, lactic acid, citric acid, oxalic acid, succinic, acid, organic sulfonic acid, and the like.

The a water-soluble polyvalent cationic salt are preferably calcium salts, such as calcium chloride, calcium formate, calcium nitrate, and calcium acetate. This is because even better uniformity of color densities and ink absorbability of the coated paper for industrial inkjet printing presses, even better capability of suppressing strike-through of inks, and even better formation of protruding parts described below are achieved. From the perspective of costs of chemicals, calcium chloride or calcium nitrate is preferable.

The coating layer may appropriately contain a binder that is conventionally known in the field of papermaking. Examples of the binder include oxidized starches, enzymatically modified starches, phosphoric acid esterified starches, cationized starches, or derivatives of these starches, cellulose derivatives, such as methylcellulose, carboxymethyl cellulose, and hydroxyethyl cellulose, polyvinyl alcohol derivatives, such as polyvinyl alcohol and silanol-modified polyvinyl alcohol, resins of natural polymer, such as casein and gelatin or modified products of these, soybean protein, pullulan, gum arabic, gum karaya, and albumin, or derivatives of these, sodium polyacrylate, polyacrylamide, and vinyl polymers such as polyvinylpyrrolidone, sodium alginate, polypropylene glycol, polyethylene glycol, maleic anhydride or copolymers of it, conjugated diene-based copolymers, such as styrene-butadiene copolymers and acrylonitrile-butadiene copolymers, acrylic copolymers, such as polymers of acrylic acid ester or methacrylic acid ester and copolymers of methacrylic acid salts or methacrylic acid esters and butadiene, vinyl-based copolymers such as ethylene-vinyl acetate copolymers and vinyl chloride-vinyl acetate copolymers, polyurethane resins, alkyd resins, unsaturated polyester, resins, and functional group-modified copolymers formed by functional group-containing monomers, such as carboxyl groups, of these copolymers, thermosetting synthetic resins such as melamine resins and urea resins, natural rubber latex, and the like.

The coating layer may contain, as necessary, conventionally known various auxiliary agents that are typically used in the field of papermaking, such as pigment dispersants, thickeners, defoamers, antifoamers, foaming agents, releasing agents, penetrating agents, wetting agents, heat gelling agents, printability improvers, dye fixing agents, lubricants, dyes, optical brighteners, and insolubilizers.

The coated paper for industrial inkjet printing presses of the present invention has the arithmetic mean roughness (Ra) stipulated in JIS B 0601:2001 (ISO 4287:1997) of the coated paper surface on the side where the coating layer is located of the present invention of 4.5 μm to 7.5 μm. When the arithmetic mean roughness (Ra) is less than 4.5 μm, paper feeding characteristics with regard to friction type paper-feeding device are deteriorated. Furthermore, when the arithmetic mean roughness (Ra) is less than 4.5 μm, gaps in the coating layer are often collapsed. As a result, ink absorbability may be deteriorated. When the arithmetic mean roughness (Ra) is more than 7.5 μm, paper feeding characteristics with regard to air suction type paper-feeding device are deteriorated. The contents of JIS B 0601:2001 and ISO 4287:1997 are incorporated herein by reference in their entirety.

In the coated paper for industrial inkjet printing presses of the present invention, the coated paper surface on the side where the coating layer is located of the present invention has 1 to 350 protruding parts per 1.0 square centimeter. The number of the protruding parts per 1.0 square centimeter is preferably 1 to 250, and more preferably 1 to 150.

The protruding part is a protruding part having the maximum width of 10 μm to 100 μm measured using a photographed image of the coated paper surface taken by magnifying 50 times using an electron microscope. The protruding part preferably does not contain a protruding part having the maximum width exceeding 100 The protruding part may contain a protruding part having the maximum width less than 10 so long as it does not impair the effects of the present invention.

The height of the protruding part is preferably 0.1 μm or less. The height exceeding 0.1 μm may affect the surface quality of the coated paper surface.

Figure 2:
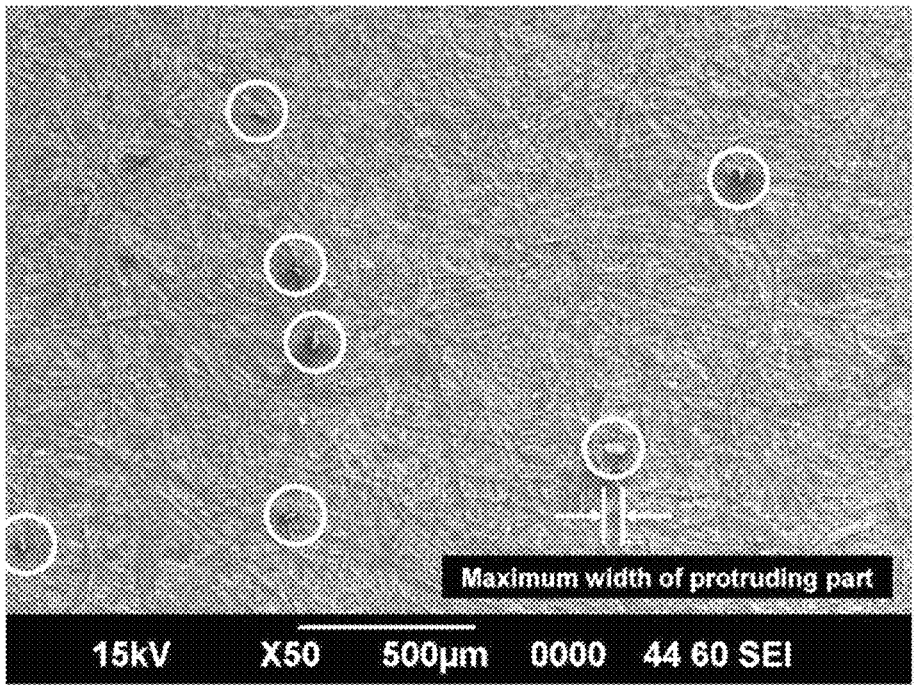
FIG. 2 is an electron micrograph showing the positions of protruding parts and the maximum width of a protruding part in a part of FIG. 1.

FIG. 1 is an electron micrograph observing a coated paper surface on the side where the coating layer is located of the coated paper for industrial inkjet printing presses of the present invention. From this photographed image, it is confirmed that the coated paper surface has protruding parts. FIG. 2 shows the protruding parts and the maximum width of a protruding part of FIG. 1. The maximum width of the protruding part is a length of the maximum width in each of the photographed protruding parts, as shown in FIG. 2.

When the number of the protruding parts is less than 1 per 1.0 square centimeter of the coated paper surface, paper feeding characteristics with regard to friction type paper-feeding device are deteriorated. When the number of the protruding parts is more than 350, paper feeding characteristics with regard to air suction type paper-feeding device are deteriorated.

In the preferred aspect of the present invention, the protruding part is formed from a combination of at least one selected from the group consisting of a cationic resin and a water-soluble polyvalent cationic salt, and kaolin.

Kaolin is typically a plate-like particle, and it is considered that the flat part of the particle is charged negatively and the edge parts are charged positively. Therefore, with the combination of kaoline and at least one selected from the group consisting of a cationic resin and a water-soluble polyvalent cationic salt, the at least one selected from the group consisting of a cationic resin and a water-soluble polyvalent cationic salt attaches on the flat part of the kaolin, and fine aggregates dispersed in the coating composition of coating layer is formed during the production process of the coated paper. Since such attaching is not firm, the aggregates are disintegrated when the coating composition of coating layer is intensely agitated or subjected to application of force, such as shearing force. By applying and drying the coating composition of coating layer in which fine aggregates have been formed, the protruding parts are formed on the coated paper surface due to the fine aggregates. The number of the protruding parts can be adjusted by the degree of formation of the aggregates in the coating composition of coating layer. The degree of formation varies depending on the type and size of kaolin and the type of the cationic resin, and also varies depending on the intensity of the agitation.

In addition to the formation of the protruding part using the combination of kaolin and at least one selected from the group consisting of a cationic resin and a water-soluble polyvalent cationic salt, the effect of the paper feeding characteristics can be achieved even when the protruding part is formed on the coated paper surface by unevenness processing treatment, such as emboss processing. However, from the perspective of easily controlling the formation of the number of the protruding parts with the maximum width according to the present invention and from the perspective of the production costs, the protruding parts are preferably formed from a combination of kaolin and at least one selected from the group consisting of a cationic resin and a water-soluble polyvalent cationic salt.

The arithmetic mean roughness (Ra) of the coated paper surface on the side where the coating layer is located according to the present invention is a conventionally known physical property in the field of coated paper and can be adjusted by conventionally known methods, such as the type of pulp for base paper, presence/absence of calender treatment and conditions thereof for base paper and/or coated paper, the applied amount of the coating layer; the average particle size and/or the particle size distribution of pigments in the coating layer, the amount of the binder, and the coating method of the coating composition of coating layer. Furthermore, the arithmetic mean roughness (Ra) can be also adjusted by the protruding parts formed by a combination of the type and the content of at least one selected from the group consisting of a cationic resin and a water-soluble polyvalent cationic salt and the type and the content of kaolin.

Examples of the calender treatment device include a machine calender, soft nip calender, super calender, multi-step calender, multi-nip calender, and the like.

The applied amount of the coating layer is not particularly limited as long as the applied amount is within the range that satisfies the Ra and the protruding part according to the present invention. Since the uniformity of color densities, ink absorbability, capability of suppressing strike-through of inks, and paper feeding characteristics become substantially equally excellent, the applied amount in terms of dry content is preferably 1.0 g/m$^2$ to 7.0 g/m$^2$ per one face.

The method of providing a coating layer on base paper is a method by which the coating composition of coating layer is coated using coating apparatus that is conventionally known in the field of coated paper, and is not particularly limited. Since satisfactory protruding part according to the present invention is likely to be obtained, coating apparatus that does not apply shearing force during application of the coating composition of coating layer is preferable. For example, an air-knife coater or film size press is preferable. Other coating apparatus is not excluded as long as the arithmetic mean roughness (Ra) and the protruding parts of the present invention are satisfied. Examples of other coating apparatus include curtain coaters, slide lip coaters, die coaters, blade coaters, Bill blade coaters, short-dwell blade coaters, gate roll coaters, bar coaters, rod coaters, roll coaters, and the like.

When a coating layer is provided on base paper, drying is preferably performed using drying apparatus after the coating composition of coating layer is coated. Examples of the drying apparatus include hot air dryers such as a linear tunnel dryer, arch dryer, air loop dryer, and sine curve air float dryer, infrared heating dryers, dryers utilizing microwave, and the like.

The coating composition of coating layer is prepared by using water as a medium, adding a pigment dispersant as necessary, dispersing kaolin and other pigment(s) thereto, adding as necessary a binder and various conventionally known auxiliary agents thereto, and further blending at least one selected from the group consisting of a cationic resin and a water-soluble polyvalent cationic salt. In the preferred aspect of the present invention, since the protruding parts are formed from a combination of kaolin and at least one selected from the group consisting of a cationic resin and a water-soluble polyvalent cationic salt, intense agitation or the like is avoided after the coating composition of coating layer is uniformly mixed in a manner that fine aggregates are formed.

The method of producing the coated paper for industrial inkjet printing presses of the present invention will be described.

The method of producing the coated paper for industrial inkjet printing presses is a production method comprising: a step of obtaining base paper; a step of obtaining a coating composition of coating layer containing at least one selected from the group consisting of a cationic resin and a water-soluble polyvalent cationic salt, and a pigment containing kaolin; and a step of obtaining a coating layer by applying the coating composition of coating layer on the base paper; wherein, the content of the kaolin in the coating layer is 30 parts by mass to 80 parts by mass based on 100 parts by mass of the pigment in the coating layer; an arithmetic mean roughness (Ra) stipulated in JIS B 0601:2001 (ISO 4287: 1997) of a coated paper surface on the side where the coating layer is located is 4.5 μm to 7.5 μm; the coated paper surface on the side where the coating layer is located has 1 to 350 protruding parts per 1.0 square centimeter; and the protruding part is a protruding part having the maximum width of 10 μm to 100 μm measured using a photographed image of the coated paper surface taken by magnifying 50 times using an electron microscope.

The industrial inkjet printing press and the coated paper for industrial inkjet printing presses are the same as the industrial inkjet printing press and the coated paper for industrial inkjet printing presses described above, and overlapping explanation will be omitted.

The step of obtaining base paper includes producing base paper or obtaining produced base paper.

The coating composition of coating layer is prepared by using water as a medium, adding pigment dispersant as necessary, dispersing kaolin and other pigment(s) thereto, adding as necessary a binder and various conventionally known auxiliary agents thereto, and further blending at least one selected from the group consisting of a cationic resin and a water-soluble polyvalent cationic salt. In the preferred aspect of the present invention, since the protruding parts are formed from a combination of kaolin and at least one selected from the group consisting of a cationic resin and a water-soluble polyvalent cationic salt, intense agitation or the like is avoided after the coating composition of coating layer is uniformly mixed in a manner that fine aggregates are formed. The protruding parts are formed on the coated paper surface due to the fine aggregates by applying and drying the coating composition of coating layer, in which fine aggregates have been formed, on the base paper. The number of the protruding parts can be adjusted by the degree of formation of the aggregates in the coating composition of coating layer. The degree of formation varies depending on the type and size of kaolin and the type of the cationic resin, and also varies depending on the intensity of the agitation.

EXAMPLES

The present invention is described below more specifically using examples, but the present invention is not limited to the following examples provided that the gist thereof is not exceeded. Furthermore, "part by mass" and "% by mass" in the examples indicate values of dry content or substantial component. The applied amount is the amount in terms of dry content.

Evaluation of Uniformity of Color Densities

Printing of 6000 m of image to be evaluated was performed using an industrial inkjet printing press, Prosper 5000XL Press, manufactured by Eastman Kodak Co. using a aqueous pigment ink at 75 m/min. Printing was performed in a manner that 3 cm×3 cm square solid patterns were recorded in a single continuous row with seven colors, namely, black, cyan, magenta, yellow, and superimposed colors (red, green, blue) created by a combination of two colors out of the above three color inks except black. The uniformity of color densities of the printed solid pattern section of each color was visually evaluated. In the present invention, the evaluation result of coated paper for industrial inkjet printing presses having excellent uniformity in color densities is 3 to 5.

5: Color densities were uniform

4: Densities were slightly uneven depending on color

3: Color densities were slightly uneven

2: Color densities were partially uneven

1: Color densities were uneven for the entire printed part

Evaluation of Ink Absorbability

Printing of 6000 m of image to be evaluated was performed using an industrial inkjet printing press, MJP20C, manufactured by Miyakoshi Printing Machinery Co., Ltd. using a aqueous dye ink at 150 m/min. Printing was performed in a manner that 2 cm×2 cm square solid patterns were recorded in a single continuous row with seven colors, namely, black, cyan, magenta, yellow, and superimposed colors (red, green, blue) created by a combination of two colors out of the above three color inks except black. Visual evaluation was performed from the perspectives of blur of boundary section of the colors and of the printed solid pattern section of each color. In the present invention, the evaluation result of coated paper for industrial inkjet printing presses having excellent ink absorbability is 3 to 5.

5: No blur was observed at the boundary section of the colors

4: Almost no blur was observed at the boundary section of the colors

3: Although blur was observed at the boundary section of the colors, the boundary was clearly recognized 2: The boundary section of the colors was not clear, and the adjacent color was slightly shifted over the boundary section 1: The boundary of each color was not clear, and degree of blur with respect to the adjacent color was significant Evaluation of Capability of Suppressing Strike-Through of Inks Printing of 6000 m of image to be evaluated was performed using an industrial inkjet printing press, Web Press T-300, manufactured by Hewlett-Packard Development Company, L.P. using a aqueous pigment ink at 100 m/min. Printing was performed in a manner that 10 cm×10 cm square solid patterns were recorded in black. Brightness was measured from the back face side of the black printed solid pattern section, using a method of measuring brightness stipulated in JIS P8148. The capability of suppressing strike-through of inks of the coated paper was evaluated by calculating the value of "brightness of white part without print (optical %)"-"brightness of back face side of black printed solid pattern section (optical %)". The measurement of brightness was performed using the PF-10 manufactured by Nippon Denshoku Industries Co., Ltd. by placing one sheet of sample on a standard plate under UV cut conditions. In the present invention, the evaluation result of coated paper for industrial inkjet printing presses having capability of suppressing strike-through of inks is 3 to 5.

5: Less than 10 optical %

4: 10 optical % or greater but less than 13 optical %

3: 13 optical % or greater but less than 16 optical %

2: 16 optical % or greater but less than 19 optical %

1: 19 optical % or greater

Evaluation of Paper Feeding Characteristics

Using F600KE Bottom Feeder, manufactured by Sanray International, Inc, as a friction type paper-feeding device and using A-FEEDER-TYPE 1, manufactured by Sanray International, Inc, as an air suction type paper-feeding device, 10000 sheets of coated paper for industrial inkjet printing presses, which was cut into A4 size, were transported. The number of times of transport troubles of feeding failure, multi feed, and skew during the paper feeding was counted. Evaluation was performed on the following scale of 1 to 5 according to the number of times. In the present invention, the evaluation result of coated paper for industrial inkjet printing presses having excellent paper feeding characteristics is 3 to 5.

5: The number of transport troubles was less than 5 in the both types

4: The number of transport troubles in one of the two types was less than 5, and the number of transport troubles in the other type was 5 or more but less than 20

3: The number of transport troubles was 5 or more but less than 20 in the both types 2: The number of transport troubles in at least one of the two types was 20 or more but less than 50

1: The number of transport troubles in at least one of the two types was 50 or more Measurement of arithmetic mean roughness (Ra) of coated paper surface on the side where coating layer is located The arithmetic mean roughness (Ra), stipulated in JIS B 0601:2001 (ISO 4287:1997), of the coated paper surface was measured using Surfcom 1400D, manufactured by Tokyo Seimitsu Co., Ltd.

Measurement of the number of protruding parts on coated paper surface on the side where coating layer is located Any arbitrarily chosen part of the coated paper for industrial inkjet printing presses was cut to 1.0 square centimeter, and the surface thereof was observed by magnifying 50 times using the scanning electron microscope JSM-6490LA, manufactured by JEOL Ltd. The number of protruding parts having the maximum width of 10 μn to 100 μm, measured using the photographed image, was counted. This operation was performed at 16 arbitrarily chosen parts, and the average value of the 16 parts was used as the number of protruding parts per 1.0 square centimeter of the coated paper surface of the coated paper for industrial inkjet printing presses. Note that, in the examples and comparative examples, it was confirmed that any protruding parts having the maximum width of less than 10 μm or more than 100 μm did not exist, and the observed protruding parts were all protruding parts having the maximum width of 10 μm to 100 μm.

The coated paper for industrial inkjet printing presses of each of examples and comparative examples was produced according to the following procedure.

Preparation of Base Paper

To pulp slurry composed of 100 parts by mass of LBKP having a freeness of 400 mL csf, 15 parts by mass of precipitated calcium carbonate as a filler, 0.8 parts by mass of amphoteric starch, 0.8 parts by mass of aluminum sulfate, and 0.05 parts by mass of alkyl ketene dimer-based sizing agent were added to prepare paper stock. The paper stock was processed using the Fourdrinier machine and then subjected to machine calender treatment to produce base paper. The papermaking conditions and the like were adjusted in a manner that the basis weight of the base paper was 80 g/m$^2$ in the end. The conditions of machine calender treatment were set in a manner that the desired arithmetic mean roughness (Ra) was achieved in the end.

Preparation of Coating Composition of Coating Layer

The coating composition of coating layer was prepared as described below.

Kaolin: The number of parts compounded is shown in Table 1

Other pigment: Type and the number of parts compounded are shown in Table 1

Polyvinyl alcohol: 5 parts by mass

Commercially available polyacrylic acid-based dispersant: 0.1 parts by mass

Compound selected from the group consisting of a cationic resin and a water-soluble polyvalent cationic salt: 10 parts by mass Types are shown in Table 1

Into water in which the commercially available polyacrylic acid-based dispersant was dissolved, the kaolin and/or the other pigment was mixed and agitated. Thereafter, the compound selected from the group consisting of a cationic resin and a water-soluble polyvalent cationic salt, and polyvinyl alcohol, which were dissolved in water in advance, were added while the mixture was agitated. A coating composition of coating layer was obtained by gently agitating the mixture for a while after the mixing. The concentration of the coating composition of coating layer was adjusted to 40% by mass in the end. Note that the coating composition of coating layer of Examples 1 to 17 and Comparative Examples 1, 2, 5, 6, and 8 had aggregates due to the blending of the kaolin and the compound selected from the group consisting of a cationic resin and a water-soluble polyvalent cationic salt. The coating composition of coating layer of Comparative Example 7 was agitated in a manner aggregates were not formed.

The pigments and cationic resin shown in Table 1 using abbreviations were as follows. Furthermore, ordinary commercial products were used as calcium chloride and calcium nitrate, which were water-soluble polyvalent cationic salts.

Kaolin: Kaofine 90, manufactured by Shiraishi Calcium Kaisha, Ltd.

Ground calcium carbonate: FMT-97, manufactured by Fimatec Ltd.

Precipitated calcium carbonate: TamaPearl TP-123 (columnar), manufactured by Okutama Kogyo Co., Ltd.

Cationic resin: Jetfix 5052, manufactured by Satoda Chemical Industrial., Ltd. (dimethylamine-epichlorohydrin polycondensate)

Production of Coating Layer

On the base paper, the coating composition of coating layer of each of examples and comparative examples shown in Table 1 was applied on the both face by applying one face at a time using the coating apparatus shown in Table 1 in a manner that the applied amount per one face was the amount shown in Table 1. After the applying, drying was performed to obtain a coating layer on the base paper.

Production of Coated Paper for Industrial Inkjet Printing Presses

After the coating layer was formed on the base paper, machine calender treatment was performed to obtain coated paper for industrial inkjet printing presses. The conditions of machine calender treatment were set in a manner that the desired arithmetic mean roughness (Ra) was achieved.

The evaluation results of the examples and the comparative examples are shown in Table 1.

TABLE 1

| | Coating layer | | | | | |
|---|---|---|---|---|---|---|
| | Pigment | | | Cationic resin and water- | Applied | Coated paper |
| | Kaolin (part by mass) | Other pigment Type | (part by mass) | soluble polyvalent cationic salt | amount per face ($g/m^2$) | Arithmetic surface roughness (Ra) (μm) |
| Example1 | 55 | Ground calcium carbonate | 45 | Calcium chloride | 4.0 | 6.2 |
| Example2 | 30 | Ground calcium carbonate | 70 | Calcium chloride | 4.0 | 6.2 |
| Example3 | 80 | Ground calcium carbonate | 20 | Calcium chloride | 4.0 | 6.2 |
| Example4 | 55 | Precipitated calcium carbonate | 45 | Calcium chloride | 4.0 | 6.2 |
| Example5 | 55 | Ground calcium carbonate | 45 | Calcium nitrate | 4.0 | 6.2 |
| Example6 | 55 | Ground calcium carbonate | 45 | Cationic resin | 4.0 | 6.2 |
| Example7 | 55 | Ground calcium carbonate | 45 | Calcium chloride | 1.0 | 6.2 |
| Example8 | 55 | Ground calcium carbonate | 45 | Calcium chloride | 7.0 | 6.2 |
| Example9 | 55 | Ground calcium carbonate | 45 | Calcium chloride | 0.5 | 6.2 |
| Example10 | 55 | Ground calcium carbonate | 45 | Calcium chloride | 8.0 | 6.2 |
| Example11 | 55 | Ground calcium carbonate | 45 | Calcium chloride | 12.0 | 6.2 |
| Example12 | 55 | Ground calcium carbonate | 45 | Calcium chloride | 4.0 | 4.8 |
| Example13 | 55 | Ground calcium carbonate | 45 | Calcium chloride | 4.0 | 7.5 |
| Example14 | 55 | Ground calcium carbonate | 45 | Calcium chloride | 4.0 | 6.2 |
| Example15 | 55 | Ground calcium carbonate | 45 | Calcium chloride | 4.0 | 6.2 |
| Example16 | 55 | Ground calcium carbonate | 45 | Calcium chloride | 4.0 | 6.2 |
| Example17 | 55 | Ground calcium carbonate | 45 | Calcium chloride | 4.0 | 4.5 |
| Comparative Example1 | 25 | Ground calcium carbonate | 75 | Calcium chloride | 4.0 | 6.2 |
| Comparative Example2 | 85 | Ground calcium carbonate | 15 | Calcium chloride | 4.0 | 6.2 |
| Comparative Example3 | 0 | Ground calcium carbonate | 100 | Calcium chloride | 4.0 | 4.5 |
| Comparative Example4 | 55 | Ground calcium carbonate | 45 | — | 4.0 | 4.5 |
| Comparative Example5 | 55 | Ground calcium carbonate | 45 | Calcium chloride | 4.0 | 3.8 |
| Comparative Example6 | 55 | Ground calcium carbonate | 45 | Calcium chloride | 4.0 | 8.0 |
| Comparative Example7 | 55 | Ground calcium carbonate | 45 | Calcium chloride | 4.0 | 6.2 |
| Comparative Example8 | 55 | Ground calcium carbonate | 45 | Calcium chloride | 4.0 | 6.2 |

| | | | Evaluation | | | |
|---|---|---|---|---|---|---|
| | Coated paper Protruding part (number/$cm^2$) | Coating apparatus | Uniformity of color densities | Ink absorbability | Capability of suppressing strike-through of inks | Paper feeding characteristics |
| Example1 | 11 | Film size press | 5 | 5 | 4 | 4 |
| Example2 | 6 | Film size press | 5 | 5 | 3 | 3 |
| Example3 | 65 | Film size press | 3 | 3 | 5 | 4 |
| Example4 | 12 | Film size press | 5 | 5 | 4 | 4 |
| Example5 | 10 | Film size press | 5 | 5 | 4 | 4 |
| Example6 | 12 | Film size press | 4 | 4 | 4 | 4 |
| Example7 | 9 | Film size press | 4 | 4 | 4 | 5 |

TABLE 1-continued

| | | | | | | |
|---|---|---|---|---|---|---|
| Example8 | 13 | Film size press | 5 | 5 | 5 | 4 |
| Example9 | 8 | Film size press | 3 | 3 | 3 | 5 |
| Example10 | 13 | Film size press | 5 | 5 | 5 | 3 |
| Example11 | 14 | Film size press | 5 | 5 | 5 | 3 |
| Example12 | 4 | Film size press | 5 | 5 | 4 | 4 |
| Example13 | 105 | Film size press | 5 | 5 | 4 | 4 |
| Example14 | 1 | Film size press | 5 | 5 | 4 | 3 |
| Example15 | 350 | Film size press | 5 | 5 | 4 | 3 |
| Example16 | 11 | Air-knife coater | 5 | 5 | 4 | 4 |
| Example17 | 1 | Blade coater | 5 | 4 | 4 | 3 |
| Comparative Example1 | 4 | Film size press | 5 | 5 | 3 | 2 |
| Comparative Example2 | 15 | Film size press | 2 | 2 | 5 | 5 |
| Comparative Example3 | 0 | Film size press | 5 | 5 | 3 | 2 |
| Comparative Example4 | 0 | Film size press | 1 | 1 | 1 | 1 |
| Comparative Example5 | 3 | Film size press | 5 | 3 | 4 | 2 |
| Comparative Example6 | 258 | Film size press | 5 | 5 | 5 | 2 |
| Comparative Example7 | 0 | Film size press | 5 | 5 | 4 | 1 |
| Comparative Example8 | 360 | Film size press | 5 | 5 | 4 | 2 |

As is clear from Table 1, Examples 1 to 17, which were the coated paper for industrial inkjet printing presses of the present invention, achieved excellent uniformity in color densities and ink absorbability, had capability of suppressing strike-through of inks, and achieved excellent paper feeding characteristics. On the other hand, it was confirmed that Comparative Examples 1 to 8, which were coated paper that did not correspond to the present invention, could not satisfy all the effects of the present invention.

The disclosure of Japanese Patent Application No. 2016-051122 (date of application: Mar. 15, 2016) is incorporated herein by reference in its entirety.

All publications, patent applications, and technical standards indicated in the present description are incorporated herein by reference to the same extent as if such individual publication, patent application, or technical standard was specifically and individually indicated to be incorporated by reference.

The invention claimed is:

1. A coated paper for industrial inkjet printing presses comprising a base paper, and a coating layer containing at least one selected from the group consisting of a cationic resin and a water-soluble polyvalent cationic salt, and a pigment containing kaolin, on the base paper, wherein the content of the kaolin is 30 parts by mass to 80 parts by mass based on 100 parts by mass of the pigment in the coating layer, an arithmetic mean roughness (Ra) stipulated in JIS B 0601:2001 (ISO 4287:1997) of a coated paper surface on the side where the coating layer is located is 4.5 μm to 7.5 μm, the coated paper surface on the side where the coating layer is located has 1 to 350 protruding parts per 1.0 square centimeter, and the protruding part is a protruding part having the maximum width of 10 μm to 100 μm measured using a photographed image of the coated paper surface taken by magnifying 50 times using an electron microscope.

* * * * *